US005604079A

United States Patent [19]

Filosa et al.

[11] Patent Number: 5,604,079

[45] Date of Patent: Feb. 18, 1997

[54] PHOTOGRAPHIC SYSTEM

[75] Inventors: Michael P. Filosa, Medfield; Edward D. Kingsley, Acton; Kenneth C. Waterman, Concord, all of Mass.

[73] Assignee: Polaroid Corporation, Cambridge, Mass.

[21] Appl. No.: 648,203

[22] Filed: May 14, 1996

[51] Int. Cl.[6] ..... G03C 8/36; G03C 8/32; G03C 5/305; G03C 8/18

[52] U.S. Cl. ..... 430/218; 430/214; 430/239; 430/244; 430/249; 430/375; 430/377; 430/390; 430/446; 430/487; 430/550; 430/543; 430/559

[58] Field of Search ..... 430/218, 214, 430/446, 487, 249, 239, 244, 375, 377, 390, 550, 543, 559

[56] References Cited

U.S. PATENT DOCUMENTS

| | | | |
|---|---|---|---|
| 3,691,210 | 9/1972 | Solodar | 260/380 |
| 4,006,150 | 2/1977 | Greenwald | 260/294.8 F |
| 4,175,966 | 11/1979 | Fujiwhara et al. | 430/438 |
| 4,203,766 | 5/1980 | Bourgeois et al. | 430/243 |
| 4,740,448 | 4/1988 | Kliem | 430/214 |
| 4,767,698 | 8/1988 | Bergthaller et al. | 430/562 |
| 5,346,800 | 9/1994 | Foley et al. | 430/213 |
| 5,415,969 | 5/1995 | Waterman | 430/213 |

*Primary Examiner*—Richard L. Schilling
*Attorney, Agent, or Firm*—Jennifer A. Kispert

[57] ABSTRACT

There is described a photographic system wherein development of an exposed photosensitive element is carried out in the presence of an acylpyridine-N-oxide compound.

21 Claims, No Drawings

PHOTOGRAPHIC SYSTEM

This invention relates to a photographic system, including photographic products and processes, which utilizes certain acylpyridine-N-oxide compounds.

BACKGROUND OF THE INVENTION

Pyridine-N-oxides which are substituted in the 2-, 3- or 4-position with an acetyl group are known compounds. (for 2-, see Katritzky et al., Soc. 2182, 2191 (1958); for 3- and 4-, see Kanno, J. Pharm. Soc. Japan 73: 120 (1953)). Pyridine-N-oxides which are substituted in the 2-, 3- or 4-positions with various substituents are known for use in photography generally.

For instance, it is known in the art, as taught by U.S. Pat. No. 3,691,210 that pyridine-N-oxide can be used in the synthesis of dye developers such as 2-(omega-hydroquinonyl-alkyl )-anthraquinones, e.g., 2-(omega-hydroquinonyl-pentyl)-1,4-dihydroxy-5,8-bis-α-ethyl-propylamino-anthraquinone.

Another use for pyridine-N-oxides in photography is described in U.S. Pat. No. 4,006,150 which discloses that pyridine-N-oxides substituted in the ortho and/or para position, i.e., in the 2- and/or 4-position, with an alkylsulfonylmethyl group are useful as photographic speed enhancers of the red-sensitive silver halide emulsion in dye developer diffusion transfer photographic processes and in color diffusion transfer processes, products and compositions employing the N-oxides of certain N-heterocyclicalkyl sulfones. It also discloses that, unlike the system described in U.S. Pat. No. 3,691,210 wherein the pyridine-N-oxide becomes part of the dye developer, the pyridine-N-oxides by themselves can be initially disposed in the processing composition or in a layer of the image-recording element.

U.S. Pat. No. 4,175,966 discloses a light-sensitive black and white silver halide photographic material containing a substantially non-diffusible compound having oxidation power on a hydroquinone developing agent. It also discloses typical examples of substantially non-diffusible compounds including "other organic oxidized compounds" such as pyridine-N-oxide polymer.

U.S. Pat. No. 4,203,766 discloses that pyridine-N-oxides can assist in the control of dye transfer in diffusion transfer photographic systems which utilize dye developers as the image dye-providing materials by minimizing the diffusion of oxidized dye developers. It is also disclosed that, in such systems, pyridine-N-oxides provide a beneficial solvating action for unoxidized dye developer, particularly, magenta dye developer, thereby improving transfer of unoxidized dye developer without rendering oxidized dye developer more diffusible than the dye developer would be under ordinary development conditions. It is further disclosed that, in such systems, pyridine-N-oxides which are substituted in any position(s) of the pyridine ring with a methyl group(s) can also provide improved color isolation, i.e., the transfer of the dye developers is more closely controlled by the silver halide emulsion with which each is associated. Among the compounds disclosed in U.S. Pat. No. 4,203,766 as being useful for this purpose are those which are substituted in the 2-, 3- and/or 4-position with a methyl group.

U.S. Pat. No. 4,767,698 discloses that pyridine-N-oxides can be used to prepare photographic cyan dye-releasing compounds. It also discloses that, these cyan dye-releasing compounds in the process of photographic development release diffusible cyan dyes which have improved lightfastness, improved spectral properties and improved resistance to reducing agents.

Diffusion transfer multicolor films are well known in the art. U.S. Pat. No. 2,983,606 discloses a subtractive color film which employs red-sensitive, green-sensitive and blue-sensitive silver halide layers having associated therewith, respectively, cyan, magenta and yellow dye developers. In such films, oxidation of the dye developers in exposed areas and consequent immobilization thereof has provided the mechanism for obtaining imagewise distribution of unoxidized, diffusible cyan, magenta and yellow dye developers which are transferred by diffusion to an image-receiving layer. While a dye developer itself may develop exposed silver halide, in practice the dye developer process has utilized a colorless developing agent, sometimes s referred to as an "auxiliary" developer, a "messenger" developer or an "electron transfer agent", which developing agent develops the exposed silver halide. The oxidized developing agent then participates in a redox reaction with the dye developer thereby oxidizing and immobilizing the dye developer in imagewise fashion. A well known messenger developer has been 4'-methylphenylhydroquinone. Commercial diffusion transfer photographic films of Polaroid Corporation including Polacolor SX-70, Time Zero and 600 have used cyan, magenta, and yellow dye developers.

U.S. Pat. Nos. 3,719,489 and 4,098,783 disclose diffusion transfer processes wherein a diffusible image dye is released from an immobile precursor by silver-initiated cleavage of certain sulfur-nitrogen containing compounds, preferably a cyclic 1,3-sulfur nitrogen ring system, and most preferably a thiazolidine compound. For convenience, these compounds may be referred to as "image dye-releasing thiazolidines". The same release mechanism is used for all three image dyes, and, as will be readily apparent, the image dye-forming system is not redox controlled.

A technique which utilizes two different imaging mechanisms, namely dye developers and image dye-releasing thiazolidines, is described and claimed in U.S. Pat. No. 4,740,448. According to this process the image dye positioned the greatest distance from the image-receiving layer is a dye developer and the image dye positioned closest to the image-receiving layer is provided by an image dye-releasing thiazolidine. The other image dye-providing material may be either a dye developer or an image dye-releasing thiazolidine.

In multicolor dye developer transfer processes, it has been recognized that, for example, less magenta density may be present in the transfer image than one would have predicted where there has been blue exposure but no green exposure, i.e., some magenta dye developer did not transfer even though there was no exposed green-sensitive silver halide to control its transfer. This problem is sometimes referred to as "magenta dropoff" and is believed to be the result of oxidation of the magenta dye developer as a result of the development of exposed blue-sensitive silver halide (rather than green-sensitive silver halide), the magenta dye developer being oxidized either directly or by an electron transfer redox reaction with oxidized messenger developer oxidized by exposed blue-sensitive silver halide. This undesired reaction is, at least in major part, because the magenta dye developer has to diffuse through the blue-sensitive silver halide layer to reach the image-receiving layer. In addition, the possibility has been recognized that yellow dye developer may be immobilized by development of green-sensitive silver halide, giving a different kind of crosstalk resulting in reduced yellow transfer density and increased magenta transfer density. Analogous situations may occur between the magenta and cyan dye developers. Such undesired interactions reduce color saturation and color separation and accuracy in the final image.

The photographic system taught by U.S. Pat. No. 4,740,448 reduces substantially the problem of crosstalk between adjacent silver halide emulsion layers in the formation of their respective imagewise distributions of diffusible image dyes. However, this phenomenon continues to occur in multicolor diffusion transfer photographic films such as those which utilize dye developers to provide the requisite imagewise distributions of diffusible cyan, magenta and yellow image dyes and also may occur to some extent in films which utilize dye developers together with thiazolidine image dye-providing materials dependent upon the particular photographic materials employed. It would be desirable to provide a multicolor diffusion transfer photographic film wherein such undesired interactions can be reduced substantially or virtually eliminated.

As the state of the art advances, novel approaches continue to be sought in order to attain the required performance criteria for these systems. Accordingly, investigations continue to be pursued to provide such beneficial effects. The present invention relates to novel photographic systems.

SUMMARY OF THE INVENTION

These and other objects and advantages are accomplished in accordance with the invention by providing a photographic system wherein development of an exposed photosensitive element with an aqueous alkaline processing composition is carried out in the presence of an acylpyridine-N-oxide compound.

Development of an exposed photosensitive element generally takes place under alkaline conditions, i.e., pH 10–12. At high pH, i.e., pH 10–14, the pKa of, e.g., an acetyl group, is low enough so that it may be ionized resulting in the presence of considerable carbanion. The carbanion can act as a nucleophile, e.g., can add to dye developer quinones or developer quinones.

The acylpyridine-N-oxides may be used during photographic processing of any exposed photosensitive element including photographic systems for forming images in black and white or in color and those wherein the final image is a metallic silver image or one formed by other image-forming materials. Further, in the diffusion transfer photographic film units of the invention the acylpyridine-N-oxide compound(s) can be provided in the photographic processing composition and/or incorporated in various locations in the image-recording element, preferably, in the photosensitive element.

As will be described in the detailed description of the preferred embodiments which follows, the utilization of acylpyridine-N-oxide compounds in image-recording elements for use in diffusion transfer provides such advantages as reduced graininess, i.e., visual sensation of nonuniformity in the developed photographic film, enhanced control over dye transfer as evidenced by better dye saturation, and reduced crosstalk or interimage effects between adjacent silver halide emulsion layers in the formation of their respective imagewise distributions of diffusible image dyes.

In addition, it has been found that the acylpyridine-N-oxide compound(s) utilized according to the invention can provide improved color isolation, i.e., the transfer of image dye-providing materials is more clearly controlled by the silver halide emulsion with which each is associated.

These and other objects and advantages which are provided in accordance with the invention will in part be obvious and in part be described hereinafter in conjunction with the detailed description of various preferred embodiments of the invention. The invention accordingly comprises the processes involving the several steps and relation and order of one or more of such steps with respect to each of the others, and the product and compositions possessing the features, properties and relation of elements which are exemplified in the following detailed disclosure, and the scope of the application of which will be indicated in the claims.

For a fuller understanding of the nature and objects of the invention, reference should be had to the following detailed description of the preferred embodiments.

DESCRIPTION OF THE PREFERRED EMBODIMENTS

The compound for use according to the invention has at least one pyridine ring substituted with at least one acyl group and is represented by formula (I) below

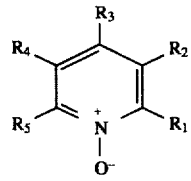

(I)

wherein:

$R_1$, $R_2$, $R_3$, $R_4$ and $R_5$ are each independently:

(a) hydrogen;

(b) linear or branched alkyl ($C_nH_{2n+1}$) wherein: n is an integer from 1 to 22;

(c) alkyl substituted with a photographically-acceptable substituent such as:

(1) aryl such as benzene;

(2) alkoxy having from 1 to 22 carbon atoms;

(3) halogen;

(4) a group represented by $$-\overset{\overset{\displaystyle O}{\|}}{C}-R_6$$

wherein:

$R_6$ is hydrogen, linear or branched alkyl ($C_nH_{2n+1}$), alkoxy having from 1 to 22 carbon atoms, or $N(R_7)_2$ wherein $R_7$ is linear or branched alkyl ($C_nH_{2n+1}$);

(5) a group represented by $$-\overset{\overset{\displaystyle R_8}{\|}}{C}-OR_9$$

wherein:

$R_8$ is oxygen or sulfur, $R_9$ is hydrogen or a linear or branched alkyl ($C_nH_{2n+1}$); and (6) a group represented by $$-(CH_2)_n-\overset{\overset{\displaystyle H}{|}}{\underset{\underset{\displaystyle R_{10}}{|}}{C}}-(CH_2)_n-CH_3$$

wherein:

$R_{10}$ is halogen, linear or branched alkyl ($C_nH_{2n+1}$), a group represented by $$-\overset{\overset{\displaystyle O}{\|}}{C}-R_{11}$$

wherein:

$R_{11}$ is hydrogen, aryl such as benzene, linear or branched alkyl ($C_nH_{2n+1}$), or a group represented by $$-\overset{\overset{\displaystyle O}{\|}}{C}-OR_{12}$$

wherein:

$R_{12}$ is linear or branched alkyl ($C_nH_{2n+1}$);

(d) aryl such as benzene;

(e) aryl substituted with a photographically-acceptable substituent such as those shown above in (c);

(f) $R_1$ and $R_2$, $R_2$ and $R_3$, $R_3$ and $R_4$, or $R_4$ and $R_5$, taken together, can represent a saturated or an unsaturated, 5- or 6-member carbocyclic or heterocyclic ring wherein the heteroatom is nitrogen, sulfur, or oxygen; or (g) halogen;

provided that at least one of $R_1$, $R_2$, $R_3$, $R_4$ and $R_5$ is an acyl group, represented by the formula below $$-\overset{\overset{\displaystyle O}{\|}}{C}-\underset{\underset{\displaystyle R_{15}}{|}}{\overset{\overset{\displaystyle R_{13}}{|}}{C}}-R_{14}$$

wherein:

$R_{13}$, $R_{14}$ and $R_{15}$ are each independently:

hydrogen;

linear or branched alkyl ($C_nH_{2n+1}$);

alkyl substituted with a photographically-acceptable substituent such as those shown above in (c);

alkoxy having from 1 to 22 carbon atoms; or halogen;

provided that at least one of $R_{13}$, $R_{14}$ or $R_{15}$ is hydrogen.

The acylpyridine-N-oxides utilized according to the invention may be prepared according to reactions which are well known by those skilled in the art, e.g., see Organic Synthesis, Collective Volumes IV, pp. 740–705, and such reactions will be particularly apparent from the detailed description of the preparation of a specific acylpyridine-N-oxide which is provided in Example I herein. In addition, the compounds of the invention are generally commercially available in their acylpyridine form and then, they may be oxidized by procedures well known to those of ordinary skill in the art to generate their N-oxide counterparts represented by formula (I) herein.

Generally, the acylpyridine-N-oxides are prepared by oxidizing acylpyridine with an appropriate oxidizing agent such as hydrogen peroxide or peracid, e.g., peracetic acid or m-chlorobenzoic peracid. Acylpyridine-N-oxide is much less volatile, i.e., vapor pressure is essentially zero, than acylpyridine, thus making it a more suitable compound for use in image-recording elements especially those using peel-apart film configurations where exposure to acylpyridine vapors is likely Suitable acylpyridine-N-oxide compounds of the present invention are shown in Table I below:

TABLE I

| Compound | $R_1$ | $R_2$ | $R_3$ | $R_4$ | $R_5$ |
|---|---|---|---|---|---|
| 1 | $COCH_3$ | H | H | H | $COCH_3$ |
| 2 | $COCH_3$ | COO | H | H | H |
| 3 | $COCH_3$ | H | H | H | $OCH_3$ |
| 4 | H | $COC_2H_5$ | H | H | H |
| 5 | $CH_3$ | $COCH_3$ | H | H | $COCH_3$ |
| 6 | $CH_3$ | $COCH_3$ | H | $COCH_3$ | $CH_3$ |
| 7 | Cl | Cl | $COCH_3$ | Cl | Cl |
| 8 | $COC_2H_5$ | H | $COCH_3$ | H | $CH_3$ |
| 9 | $CH_3$ | H | $CH_3$ | $COCH_3$ | $CH_3$ |

TABLE I-continued

| Compound | $R_1$ | $R_2$ | $R_3$ | $R_4$ | $R_5$ |
|---|---|---|---|---|---|
| 10 | $CH_3$ | H | $CH_3$ | $COCH_3$ | H |
| 11 | $COCH_3$ | $COCH_3$ | H | H | H |

As mentioned above, the compounds of Table I may be prepared by oxidizing commercially available compounds, e.g., compound 1 (Aldrich, Fluka, ICN-RF), compound 4 (ICN-RF, Lancaster), compound 6 (Aldrich) and compounds 7 and 9 (Sigma Aldrich Rare Chemicals).

Further suitable acylpyridine-N-oxide compounds of the present invention are:

(i)

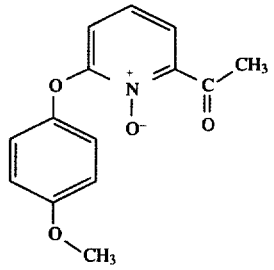

(ii)

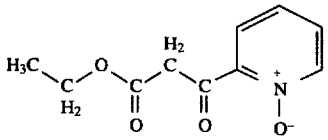

Typical suitable acylpyridine-N-oxide compounds according to formula (I) wherein $R_1$ and $R_2$, taken together, form an unsaturated, 5- or 6-member carbocyclic ring are:

(iii)

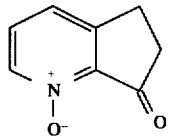

(iv)

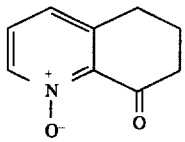

A typical suitable acylpyridine-N-oxide compound according to formula (I) where $R_3$ and $R_4$, taken together, form a saturated, 6-member carbocyclic ring is:

(v)

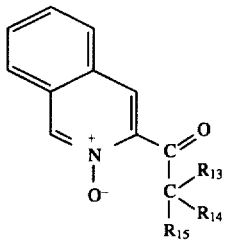

Typical suitable acylpyridine-N-oxide compounds according to formula (I) where $R_4$ and $R_5$, taken together, form a saturated or an unsaturated, 5- or 6-member carbocyclic ring are:

(vi)

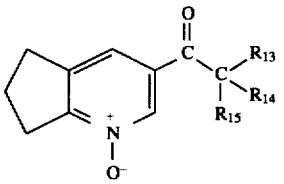

(vii)

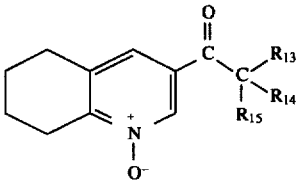

(viii)

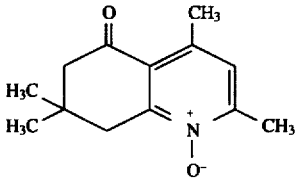

(ix)

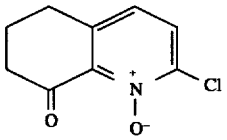

(x)

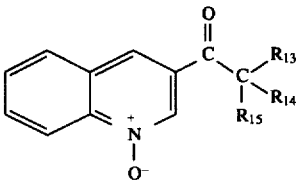

(xi)

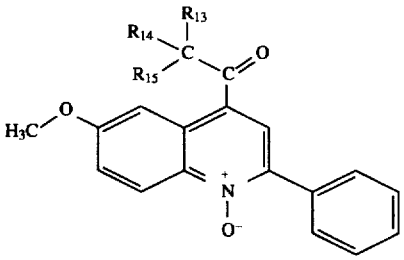

Specific preferred acylpyridine-N-oxide compounds of the present invention are shown in Table II below:

TABLE II

| Compound | $R_1$ | $R_2$ | $R_3$ | $R_4$ | $R_5$ |
|---|---|---|---|---|---|
| 1 | $COCH_3$ | H | H | H | H |
| 2 | H | $COCH_3$ | H | H | H |
| 3 | H | H | $COCH_3$ | H | H |

These acylpyridine-N-oxide compounds may be used in the photographic processing of any exposed photosensitive elements and in any amount which is required to accomplish their intended purpose. The amount of compound(s) necessary in any specific instance is dependent upon a number of factors such as, for example, the specific acylpyridine-N-oxide(s) utilized, the type of photosensitive element and the result desired. Routine scoping tests may be conducted to ascertain the concentration which is appropriate for any given photographic element.

According to a preferred embodiment there are provided according to the invention diffusion transfer photographic film units as will be discussed more in detail below herein. In such diffusion transfer photographic film units the acylpyridine-N-oxides are preferably incorporated in the photosensitive element. It should be noted here, however, that the acylpyridine-N-oxides of the invention may be incorporated in other locations in the diffusion transfer film units such as, for example, in the image-receiving element and/or in the photographic processing composition which is typically enclosed in a rupturable container, usually arranged between the photosensitive and image-receiving elements, as is known in the art. Furthermore, the same and/or a different acylpyridine-N-oxide(s) can be used simultaneously in the rupturable container containing the processing composition and/or in various locations in the image-recording elements of the invention.

The acylpyridine-N-oxides may be used during photographic processing of any exposed photosensitive element including photographic systems for forming images in black and white or in color and those wherein the final image is a metallic silver image or one formed by other image-forming materials.

The acylpyridine-N-oxides may be used in conjunction with any photographic emulsion. In the preferred diffusion transfer film units of the invention, it is preferred to include a negative working silver halide emulsion, i.e., one which develops in the areas of exposure. Further, these compounds may be used in association with any image dye-providing materials, for example, complete dyes or dye intermediates, e.g., color couplers, or dye-developers. The dye developers contain, in the same molecule, both the chromophoric system of a dye and a silver halide developing function as is described in U.S. Pat. No. 2,983,606.

In a particularly preferred embodiment the diffusion transfer photographic film elements of the invention include one or more image dye-providing materials which may be initially diffusible or nondiffusible. In diffusion transfer photographic systems the image dye-providing materials which can be utilized generally may be characterized as either (1) initially soluble or diffusible in the processing composition but which are selectively rendered nondiffusible imagewise as a function of development; or (2) initially insoluble or nondiffusible in the processing composition but which selectively provide a diffusible product imagewise as a function of development. The requisite differential in mobility or solubility may be obtained, for example, by a chemical reaction such as a redox reaction as is the case with dye developers, a coupling reaction or by a silver-assisted cleavage reaction as is the case with thiazolidines. As noted previously, more than one image-forming mechanism may be utilized in multicolor diffusion transfer film units.

Other image dye-providing materials which may be used include, for example, initially diffusible coupling dyes such as are useful in the diffusion transfer process described in U.S. Pat. No. 2,087,817 which are rendered nondiffusible by coupling with the oxidation product of a color developer; initially nondiffusible dyes which release a diffusible dye following oxidation, sometimes referred to as "redox dye releaser" dyes, described in U.S. Pat. Nos. 3,725,062 and 4,076,529; initially nondiffusible image dye-providing materials which release a diffusible dye following oxidation and intramolecular ring closure as are described in U.S. Pat. No. 3,433,939 or those which undergo silver assisted cleavage to release a diffusible dye in accordance with the disclosure of U.S. Pat. No. 3,719,489; and initially nondiffusible image dye-providing materials which release a diffusible dye following coupling with an oxidized color developer as described in U.S. Pat. No. 3,227,550. In a particularly preferred embodiment of the invention the image dye-providing materials are dye-developers which are initially diffusible materials.

Particularly preferred diffusion transfer film units according to the invention include, as image dye-providing materials, both dye developers and dye-providing thiazolidine compounds as described in U.S. Pat. No. 4,740,448 and, as shown in Example II herein.

Particularly preferred diffusion transfer photographic film units according to the invention are those intended to provide multicolor dye images. The most commonly employed photosensitive elements for forming multicolor images are of the "tripack" structure and contain blue-, green- and red-sensitive silver halide emulsion layers each having associated therewith in the same or a contiguous layer a yellow, a magenta and a cyan image dye-providing material, respectively. Suitable photosensitive elements and their use in the processing of diffusion transfer photographic images are well known and are disclosed, for example, in U.S. Pat. Nos. 2,983,606; 3,345,163; and 4,322,489. A particularly preferred type of diffusion transfer film unit according to the invention is that where the image-receiving element is designed to be separated from the photosensitive element after exposure and photographic processing has been completed—the so-called "peel-apart" type. However, the diffusion transfer film units according to the invention may also be of the so-called "integral" type where the entire film unit is maintained together.

As stated above, the multicolor diffusion transfer photographic film units of the invention include those where the photosensitive element and the image-receiving element are maintained in superposed relationship before, during and after exposure as described in U.S. Pat. No. 3,415,644. Such film units are typically referred to in the art as "integral" film units. In commercial embodiments of this type of film (e.g. SX-70 film) the support for the photosensitive element is opaque, the support for the image-receiving element is transparent and a light-reflecting layer against which the image formed in the image-receiving layer may be viewed is formed by distributing a layer of processing composition containing a light-reflecting pigment (titanium dioxide) between the superposed elements. By also incorporating suitable pH-sensitive optical filter agents, preferably pH-sensitive phthalein dyes, in the processing composition, as described in U.S. Pat. No. 3,647,347, the film unit may be ejected from the camera immediately after the processing composition has been applied with the process being completed in ambient light while the photographer watches the transfer image emerge.

As noted above, subtractive multicolor diffusion transfer films comprise a blue-sensitive silver halide emulsion in association with a yellow image dye, a green-sensitive silver halide emulsion in association with a magenta image dye, and a red-sensitive silver halide emulsion in association with a cyan image dye. Each silver halide emulsion and its associated image dye-providing material may be considered to be a "sandwich", i.e., the red sandwich, the green sandwich and the blue sandwich. Similarly, the associated layers which cooperate (e.g., the red-sensitive silver halide emulsion and its associated cyan dye developer) to create each imagewise distribution of diffusible image dye may be referred to collectively as, e.g., the red image component of the photosensitive element. It should be noted that the particular image component may contain other layers such as interlayers and timing layers. In a film unit of the type described in U.S. Pat. No. 3,415,644 and, as shown in Example II herein, the red sandwich or image component is positioned closest to the support for the photosensitive element, and the blue image component is positioned the farthest from said support and closest to the image-receiving layer. In a film unit of the type described in U.S. Pat. No. 3,594,165 the red image component is closest to the support for the photosensitive element, and it also is the closest to the image-receiving layer since said layer is carried by the same support. Accordingly, the blue image component is most distant from said support and from the image-receiving layer.

As stated earlier, the present invention may be practiced with any multicolor diffusion transfer photographic film units and these film units may include any image dye-providing materials. In the particularly preferred embodiments of the invention the cyan and magenta image dyes are dye developers and the yellow image dye is a thiazolidine. In a particularly preferred embodiment the red sandwich, or image component, is positioned closest to the support for the photosensitive element and the blue image component is positioned farthest from the support of the photosensitive element and closest to the image-receiving layer. In this embodiment, the red sandwich and the green sandwich are positioned farthest from the rupturable container releasably holding the processing composition; hence, it is also preferred that the acylpyridine-N-oxide(s) be incorporated into the image-recording element. Image-recording elements useful in both black and white and color photographic imaging systems are well known in the art and, therefore, extensive discussion of such materials is not necessary.

Briefly, for example, a preferred embodiment of a photographic diffusion transfer film unit wherein the image-receiving element is designed to be separated from the photosensitive element after exposure and photographic processing typically includes: (1) a photosensitive element comprising a support carrying at least one silver halide emulsion layer; (2) a second sheet-like element which is superposed or superposable on said photosensitive element; (3) an image-receiving layer positioned in one of said photosensitive or second sheet-like elements; (4) a rupturable container releasably holding an aqueous alkaline processing composition and so positioned as to be adapted to distribute said processing composition between predetermined layers of said elements, and (5) an acylpyridine-N-oxide compound(s) represented by formula (I). Further, the photosensitive element preferably includes an image dye-providing material in association with said silver halide emulsion layer(s). Moreover, the photosensitive element preferably includes a red-sensitive silver halide emulsion having a cyan image dye-providing material associated therewith, a green-sensitive silver halide emulsion layer having a magenta image dye-providing material associated therewith and a blue-sensitive silver halide emulsion layer having a yellow image dye-providing material associated therewith.

Furthermore, the preferred image-receiving element mentioned above comprises a support carrying a polymeric acid-reacting layer, a timing (or spacer) layer and an image-bearing layer. Each of the layers carried by the support functions in a predetermined manner to provide desired diffusion transfer photographic processing as is known in the art. It should also be understood that the image-receiving layer may include additional layers such as a strip-coat layer and an overcoat layer as is known in the art.

Support material can comprise any of a variety of materials capable of carrying the other layers of image-receiving element. Paper, vinyl chloride polymers, polyamides such as nylon, polyesters such as polyethylene terephthalate, or cellulose derivatives such as cellulose acetate or cellulose acetate-butyrate, can be suitably employed. Depending upon the desired nature of the finished photograph, the nature of support material as a transparent, opaque or translucent material will be a matter of choice. Typically, an image-receiving element adapted to be used in peel-apart diffusion transfer film units and designed to be separated after processing will be based upon an opaque support material. While the support material of the image-receiving element shown in Example II herein will preferably be an opaque material for production of a photographic reflection print, it will be appreciated that support will be a transparent support material where the processing of a photographic transparency is desired. In one embodiment where the support material is a transparent sheet material, an opaque sheet (not shown), preferably pressure-sensitive, can be applied over the transparent support to permit in-light development. Upon photographic processing and subsequent removal of the opaque pressure-sensitive sheet, the photographic image diffused into image-bearing layer can be viewed as a transparency. In another embodiment where support material is a transparent sheet, opacification materials such as carbon black and titanium dioxide can be incorporated in the processing composition to permit in-light development.

As mentioned above, the preferred film unit includes a pressure-rupturable container, or pod, as is common in the art. Such pods and like structures are common in the art and generally define the means for providing the processing composition to the photosensitive element and image-receiving element. The processing composition typically comprises an aqueous alkaline composition which may include a silver halide developing agent and other addenda as is known in the art. Examples of such processing compositions are found in U.S. Pat. Nos. 3,445,685; 3,597,197; 4,680,247; 4,756,996 and 5,422,233, as well as the patents cited therein. The processing composition utilized in the diffusion transfer film units of the invention may include one or more of the acylpyridine-N-oxide compounds described above.

The photosensitive system referred to above comprises a photosensitive silver halide emulsion. In a preferred color embodiment of the invention a corresponding image dye-providing material is provided in conjunction with the silver halide emulsion. The image dye-providing material is capable of providing, upon processing, a diffusible dye which is capable of diffusing to the image-receiving layer as a function of exposure. As described previously, preferred photographic diffusion transfer film units are intended to provide multicolor dye images and the photosensitive element is preferably one capable of providing such multicolor dye images. In a preferred black and white embodiment, the image-forming material utilized is complexed silver which diffuses from the photosensitive element to the image-receiving layer during processing. As stated earlier, both such photosensitive systems are well known in the art.

As mentioned previously, preferably, the image-receiving element of the invention includes a polymeric acid-reacting layer. The polymeric acid-reacting layer reduces the environmental pH of the film unit, subsequent to transfer image formation. As disclosed, for example, in U.S. Pat. No. 3,362,819, the polymeric acid-reacting layer may comprise a nondiffusible acid-reacting reagent adapted to lower the pH from the first (high) pH of the processing composition in which the image material (e.g. image dyes) is diffusible to a second (lower) pH at which they are not diffusible. The acid-reacting reagent is preferably a polymer which contains acid groups, e.g., carboxylic acid or sulfonic acid groups, which are capable of forming salts with alkaline metals or with organic bases, or potentially acid-yielding groups such as anhydrides or lactones. Thus, reduction in the environmental pH of the film unit is achieved by the conduct of a neutralization reaction between the alkali provided by the processing composition and a layer which comprises immobilized acid-reactive sites and which functions as a neutralization layer. Preferred polymers such a neutralization layer comprise such polymeric acids as cellulose acetate hydrogen phthalate; polyvinyl hydrogen phthalate; polyacrylic acid; polystyrene sulfonic acid; and maleic anhydride copolymers and half esters thereof.

Further, a polymeric acid-reacting layer can be applied, if desired, by coating the support layer with an organic solvent-based or water-based coating composition. A polymeric acid-reacting layer which is typically coated from an organic-based composition comprises a mixture of a half butyl ester of polyethylene/maleic anhydride copolymer with polyvinyl butyral. A suitable water-based composition for the provision of a polymeric acid-reacting layer comprises a mixture of a water soluble polymeric acid and a water soluble matrix, or binder, material. Suitable water-soluble polymeric acids include ethylene/maleic anhydride copolymers and poly(methyl vinyl ether/maleic anhydride). Suitable water-soluble binders include polymeric materials such as polyvinyl alcohol, partially hydrolyzed polyvinyl acetate, carboxymethyl cellulose, hydroxyethyl cellulose, hydroxypropyl cellulose, polymethylvinylether or the like, as described in U.S. Pat. No. 3,756,815. As examples of useful polymeric acid-reacting layers, in addition to those disclosed in the aforementioned U.S. Pat. Nos. 3,362,819 and 3,756,815, mention may be made of those disclosed in U.S. Pat. Nos.: 3,765,885; 3,819,371; 3,833,367 and 3,754,910.

As mentioned previously, preferably, the image-receiving element of the invention includes a timing layer. A timing layer can control the initiation and the rate of capture of alkali by the acid-reacting polymer layer. The timing layer may be designed to operate in a number of ways. For example, the timing layer may act as a sieve, slowly metering the flow of alkali there through. Alternatively, the timing layer may serve a "hold and release" function; that is, the timing layer may serve as an alkali impermeable barrier for a predetermined time interval before converting in a rapid and quantitatively substantial fashion to a relatively alkali permeable condition, upon the occurrence of a predetermined chemical reaction. Examples of suitable materials for use as timing layers are described in U.S. Pat. Nos. 3,575,701; 4,201,587; 4,288,523; 4,297,431; 4,391,895; 4,426,481; 4,458,001; 4,461,824 and 4,547,451. As described in these patents, timing layers having the previously described characteristics can be prepared from polymers which comprise repeating units derived from polymerizable monomeric compounds containing groups which undergo a predetermined chemical reaction as a function of contact with alkali and which are then rendered permeable to alkali. Monomeric compounds which are capable of undergoing a beta-elimination or which undergo an hydrolytic degradation after a predetermined period of impermeability to alkali can be employed in the production of suitable polymeric timing layer materials.

Polymeric materials suitable for the production of timing layers will typically be copolymers comprising repeating units of the previously described type (i.e., repeating units derived from polymerizable monomers capable of undergoing an alkali-initiated chemical reaction after a predetermined "hold" time interval) and comonomeric units incorporated into the polymer to impart thereto predetermined properties. For example, the "hold time", i.e., the time interval during which the timing layer remains impermeable to alkali during processing, can be affected by the relative hydrophilicity of the layer resulting from incorporation of a given comonomer or mixture of comonomers into the timing layer polymer. In general, the more hydrophobic the polymer, the slower will be the rate of permeation of alkali into the timing layer to initiate the alkali-activated chemical reaction, i.e., the longer the alkali hold time. Alternatively, adjustment of the hydrophobic/hydrophilic balance of the polymer by inclusion of appropriate comonomeric units may be used to impart predetermined permeability characteristics to a timing layer as appropriate for a given usage within a film unit.

The predetermined hold time of the timing layer can be adjusted as appropriate for a given photographic process by means such as controlling the molar ratio or proportion of repeating units which undergo the desired alkali-initiated chemical reaction; altering the thickness of the timing layer;

incorporation of appropriate comonomeric units into the polymeric to impart thereto a desired hydrophobic/hydrophilic balance or degree of coalescence; using different activating groups to affect the initiation and rate of the alkali-initiated chemical reaction; or utilizing other materials, particularly polymeric materials, in the timing layer to modulate the permeation of alkali into the timing layer, thereby altering the time necessary for initiation of the desired and predetermined chemical reaction. This latter means of adjusting the hold time of the timing layer may include, for example, utilization of a matrix polymer material having a predetermined permeability to alkali or aqueous alkaline processing composition as determined, for example, by the hydrophobic/hydrophilic balance or degree of coalescence thereof.

In general, increased permeability to alkali or aqueous alkaline processing composition, and thus, a shorter hold time, may be obtained by increasing the hydrophilicity of the matrix polymer or decreasing the degree of coalescence. Alternatively, decreased permeability of alkali or aqueous alkaline processing composition into the timing layer and, thus, a longer hold time, may be obtained by increasing the hydrophobicity of the matrix polymer or increasing the degree of coalescence.

Examples of suitable comonomers which can be used in the production of copolymeric materials suited to application in the timing layer(s) of the present invention include acrylic acid; methacrylic acid; 2-acrylamido-2-methylpropane sulfonic acid; N-methyl acrylamide; methacrylamide; ethyl acrylate; butyl acrylate; methyl methacrylate; N-methyl methacrylamide; N-ethyl acrylamide; N-methylolacrylamide; N,N-dimethyl acrylamide; N,N-dimethyl methacrylamide; N-(n-propyl)acrylamide; N-isopropyl acrylamide; N-(β-hydroxy ethyl) acrylamide, N-(β-dimethylaminoethyl) acrylamide; N-(t-butyl)acrylamide; N-[β-(dimethylamino-)ethyl]methacrylamide; 2-[2'-(acrylamido)ethoxy]ethanol; N-(3'-methoxy propyl)acrylamide; 2-acrylamido-3-methol butyramide; acrylamido acetamide; methacrylamido acetamide; 2-[2-methacrylamido-3'methyl butyramido]acetamide; and diacetone acrylamide.

Matrix polymer systems adapted to utilization in a timing layer can be prepared by physical mixing of the matrix polymer and the polymer containing the repeating units capable of undergoing alkali-initiated chemical reaction, or by the preparation of a timing layer polymer in the presence of a pre-formed matrix polymer. Polymers which may be used as matrix polymers will generally be copolymers which comprise comonomer units such as acrylic acid; methacrylic acid; methyl methacrylate; 2-acrylamido-2methylpropane sulfonic acid; acrylamide; methacrylamide; N,N-dimethyl acrylamide; ethyl acrylate; butyl acrylate; diacetone acrylamide; acrylamido acetamide; methacrylamido acetamide.

In the production of copolymeric timing layer materials, and in the production of matrix polymers, the comonomeric units, as well as the ratios thereof, should be chosen on the basis of the physical characteristics desired in the matrix polymer and in the timing layer in which it is to be utilized.

Reference has been made to the utilization (in timing layers containing polymers capable of undergoing alkali-initiated chemical reaction) of other materials, particularly polymeric materials, to adjust the hold time of the timing layer in a predetermined manner and as appropriate for a given photographic process. It will be understood, however, that the presence in the timing layer of polymer or other materials which adversely affect or negate the desired alkali impermeable barrier properties of the timing layer is to be avoided. In this connection, it should be noted that gelatin, and particularly unhardened gelatin, is readily swollen and permeated by aqueous alkaline compositions typically employed in photographic processing. Accordingly, the presence in a timing layer of the invention of amounts of gelatin or other materials which promote rapid permeation of the layer by alkali and which effectively negate the hold character of the layer are to be avoided. The timing layer is typically applied as a water-impermeable layer which results from the coalescence and drying of a coating composition, e.g., a latex composition.

As mentioned earlier, the image-receiving layer of the invention is designed for receiving an image-forming material which diffuses in an imagewise manner from the photosensitive element during processing. In color embodiments of the present invention, the image-receiving layer generally comprises a dyeable material which is permeable to the alkaline processing composition. The dyeable material may comprise polyvinyl alcohol together with a polyvinyl pyridine polymer such as poly(4-vinyl pyridine). Such image-receiving layers are further described in U.S. Pat. No. 3,148,061. Another image-receiving layer material comprises a graft copolymer of 4-vinyl pyridine and vinylbenzyltrimethylammonium chloride grained onto hydroxyethyl cellulose. Such graft copolymers and their use as image-receiving layers are further described in U.S. Pat. Nos. 3,756,814 and 4,080,346. Other materials can, however, be employed. Suitable mordant materials of the vinylbenzyltrialkylammonium type are described, for example, in U.S. Pat. No. 3,770,439. Mordant polymers of the hydrazinium type (such as polymeric mordants prepared by quaternization of polyvinylbenzyl chloride with a disubstituted asymmetric hydrazine) can be employed. Such mordants are described in Great Britain Pat. No. 1,022,207, published Mar. 9, 1966. One such hydrazinium mordant is poly(1-vinylbenzyl 1,1-dimethylhydrazinium chloride) which, for example, can be admixed with polyvinyl alcohol for provision of a suitable image-receiving layer.

In black and white embodiments of the invention, the image-forming material utilized is complexed silver which diffuses from the photosensitive element to the image-receiving layer during processing. The image-receiving layer utilized in such black and white embodiments typically includes silver nucleation materials, as is well known in the art.

As noted previously, the image-receiving element of the invention may include other layers such as a strip-coat layer which is designed to facilitate the separation of the image-receiving element from the photosensitive element. Many materials have been disclosed in the an for use in strip-coat layers. Typical suitable strip-coat materials are described in U.S. Pat. Nos. 4,009,031 and 5,346,800.

The image-receiving element of the invention may also include an overcoat layer as described in U.S. Pat. No. 5,415,969 and copending, commonly-assigned continuation-in-part U.S. application Ser. No. 08/382,880, filed Feb. 2, 1995, wherein water-insoluble particles are provided in a binder material. Such an overcoat layer comprises a majority by dry weight of water-insoluble particles and a minority by dry weight of a binder material. The particles are substantially insoluble in water and non-swellable when wet. Furthermore, in order to minimize any light scatter by the overcoat layer, the particles typically have a small average particle size, for example, less than 300 mm and preferably less than 100 nm, and more preferably in the range of about 1 nm to 50 nm. The water-insoluble particles may comprise inorganic materials, e.g. colloidal silica, and/or organic materials, e.g. water-insoluble polymeric latex particles such as an acrylic emulsion resin. Colloidal silica is the preferred inorganic particle for use in such an overcoat layer, however, other inorganic particles may be used in combination or substituted therefor.

The binder material for the overcoat layer preferably comprises a water-insoluble latex material, however, the layer may comprise water soluble materials or combinations of water-insoluble and water soluble materials. Examples of applicable water soluble binder materials include ethylene acrylic acid, polyvinyl alcohol, gelatin, and the like.

One or more overcoat layers may be used in combination with other layers. Typically, each overcoat layer has a thickness of up to about 2 microns, and preferably between 1 and 1.5 microns. Such overcoat layers must allow sufficient image-providing material to be transferred to the image-receiving layer to provide a photograph of the desired quality. Furthermore, since the overcoat layer(s) remains upon the image-receiving element after processing and separation from the photosensitive element, the overcoat layer(s) should not scatter visible light to any appreciable degree since the photograph will be viewed through such layer(s).

As noted previously, the photographic diffusion transfer film units according to the invention include black and white photographic film units. In such embodiments, a photosensitive element including a photosensitive silver halide emulsion is exposed to light and subjected to an aqueous alkaline solution comprising a silver halide developing agent and a silver halide solvent. The developing agent reduces exposed silver halide to an insoluble form and the unexposed silver halide, solubilized by the silver solvent, migrates to an image-receiving element. The image-receiving element typically comprises a support and an image-receiving layer including a silver precipitating material wherein the soluble silver complex is precipitated or reduced to form a visible silver black and white image. The binder material for the overcoat layer in black and white embodiments should be permeable to the photographic alkaline processing fluid and to complexed silver salt which transfers to the image-receiving layer to provide an image. Examples of such black and white photographic film units are disclosed in U.S. Pat. Nos. 3,567,442; 3,390,991 and 3,607,269 and in E. H. Land, H. G. Rogers, and V. K. Walworth, in J. M. Sturge, ed., *Neblette's Handbook of Photography and Reprography*, 7th ed., Van Nostrand Reinhold, New York, 1977, pp. 258–330.

The invention will now be described further in detail with respect to specific preferred embodiments by way of examples, it being understood that these are intended to be illustrative only and the invention is not limited to the materials, conditions, process parameters, etc. recited therein. All parts and percentages recited are by weight unless otherwise stated.

EXAMPLE I

Preparation of 3-acetylpyridine-N-oxide

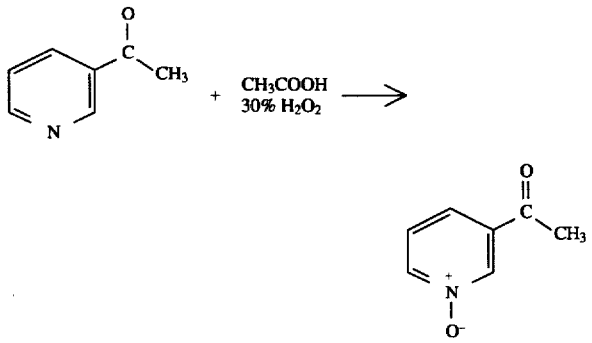

Hydrogen peroxide (20.9 ml, 0.61453 moles, Baker) and acetic acid (125 ml, Baker) were combined and stirred at room temperature (RT). The 3-acetylpyridine (50 ml, 0.40984 moles, Aldrich), distilled prior to use (94° C., 2.00 mm Hg), was added and then, the reaction mixture was stirred overnight (O/N) at 95° C. Next, the reaction mixture was cooled to RT and then, neutralized with saturated $K_2CO_3$ (400 ml). Then, 5 g of $KSO_3$ was added to destroy the remaining hydrogen peroxide. Next, methanol (750 ml) was added and the resultant cloudy solution was filtered. The filtrate was then evaporated to dryness using a rotary evaporator. The semi-solid was extracted repeatedly with hot $CH_2Cl_2$ (4×500 ml) and combined. Next, the solvent was removed leaving approximately 44 g of a crude, pale yellow solid. The crude solid was dissolved in hot 2-propanol (150 ml) and stirred until cool in an icebath. The white solid which precipitated was collected, washed with 2-propanol (100 ml) and dried in a vacuum dessicator O/N at 50° C. The air-dried weight was 41 g. HPLC analysis of the recrystallized sample (m.p. 146°–147° C.) showed a single principal peak 96% by area.

EXAMPLE II

Photographic film unit utilizing 3-acetylpyridine-N-oxide

Two diffusion transfer photographic film units were prepared: (1) a "test" film unit, i.e., a film unit prepared according to the invention, and (2) a "control" film unit, i.e., a film unit prepared according to the invention but for the inclusion of an acylpyridine-N-oxide(s) compound. More specifically, as will be described in detail below, the photosensitive element of the "test" film unit prepared according to the invention included a 3-acetylpyridine-N-oxide compound according to the invention.

The image-receiving elements used in both of the "peel-apart" film units described above comprised a white-pigmented polyethylene-coated opaque photographic film support having coated thereon in succession:

1. a polymeric acid-reacting layer coated at a coverage of about 21,522 mg/m$^2$ comprising a 1.2/1 ratio of AIRFLEX™ 465 (a vinyl acetate ethylene latex from Air Products Co.) and GANTREZ™ S-97 (a free acid of a copolymer of methyl vinyl ether and maleic anhydride from GAF Corp.);
2. a timing layer coated at a coverage of about 4950 mg/m$^2$ comprising 3 parts of a copolymer of diacetone acrylamide and acrylamide grafted onto polyvinyl alcohol and 1 part of an aqueous polymeric emulsion, i.e., aliphatic polyester urethane polymer commercially available under the tradename Bayhydrol PU-402A (Bayer);
3. an image-receiving layer coated at a coverage of about 3228 mg/m$^2$ comprising: 2 parts of a terpolymer comprising vinylbenzyltrimethylammonium chloride, vinylbenzyltriethylammonium chloride and vinylbenzyldimethyldodecylammonium chloride (6.7/3.3/1 weight %, respectively) and 1 part AIRVOL™ 425 (a fully hydrolyzed polyvinyl alcohol from Air Products Co.); and
4. a strip coat layer coated at a coverage of about 134 mg/m$^2$ comprising about 40% by weight of a terpolymer of acrylic acid, hydroxypropyl methacrylate and 4-vinylpyrrolidone and about 60% by weight of carboxymethyl guar.

Diffusion transfer photographic film units which can include the polyester urethane polymer in layer 2 above are described and claimed in copending, commonly-assigned U.S. patent application Ser. No. 08/645,803, filed on even date herewith (Case No. 8115) by Edward P. Lindholm and James J. Manning.

The photosensitive element utilized in the "control" diffusion transfer photographic film unit comprised an opaque subcoated polyethylene terephthalate photographic film base carrying in succession:

1. a cyan dye developer layer comprising about 807 mg/m$^2$ of the cyan dye developer represented by the formula

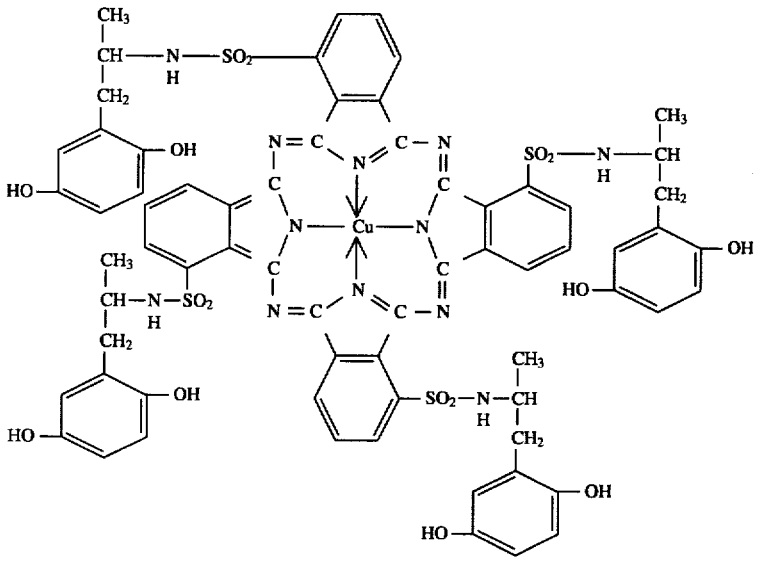

about 448 mg/m$^2$ of gelatin, about 15 mg/m$^2$ of zinc bis (6-methylaminopurine) and about 120 mg/m$^2$ of bis-2,3-(acetamidomethylnorbornyl) hydroquinone ("AMNHQ");

2. a red-sensitive silver iodobromide layer comprising about 224 mg/m$^2$ of silver iodobromide (0.7 μm), about 785 mg/m$^2$ of silver iodobromide (1.5 μm), about 112 mg/m$^2$ of silver iodobromide ( 1.8 μm) and about 561 mg/m$^2$ of gelatin;
3. an interlayer comprising about 2325 mg/m$^2$ of a copolymer of butyl acrylate/diacetone acrylamide/methacrylic acid/styrene/acrylic acid, about 97 mg/m$^2$ of polyacrylamide, about 124 mg/m$^2$ of N-hydroxymethyldimethylhydantoin and about 3 mg/m$^2$ of succindialdehyde;
4. a magenta dye developer layer comprising about 374 mg/m$^2$ of a magenta dye developer represented by the formula

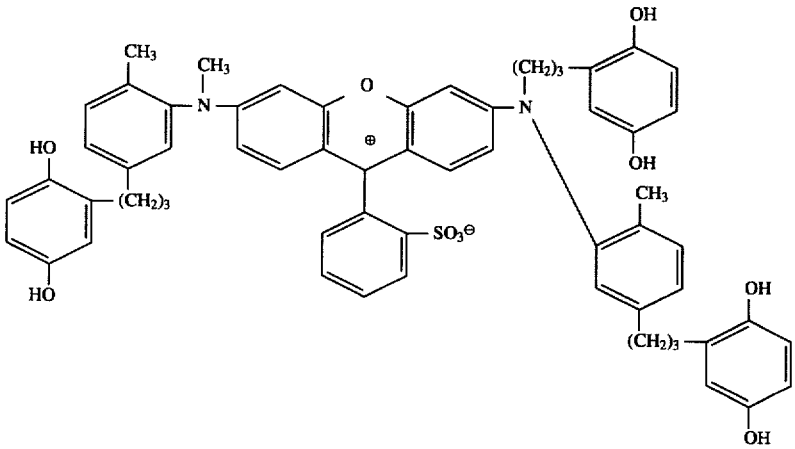

about 400 mg/m$^2$ of 2-phenyl benzimidazole, about 20 mg/m$^2$ of a cyan filter dye and about 248 mg/m$^2$ of gelatin;

5. a spacer layer comprising about 250 mg/m$^2$ of carboxylated styrenebutadiene latex (Dow 620 latex) and about 83 mg/m$^2$ of gelatin;
6. a green-sensitive silver iodobromide layer comprising about 236 mg/m$^2$ of silver iodobromide (0.6 μm), about 33 mg/m$^2$ of silver iodobromide (1.1 μm), about 378 mg/m$^2$ of silver iodobromide (1.3 μm) and about 437 mg/m$^2$ of gelatin;
7. a layer comprising about 100 mg/m$^2$ AMNHQ, about 20 mg/m$^2$ of bis (6-methylaminopurine), about 75 mg/m$^2$ of 6-hydroxy-4,4-5,7,8-pentamethyl-3,4-dihydrocoumarin and about 73 mg/m$^2$ of gelatin;
8. an interlayer comprising about 1448 mg/m$^2$ of the copolymer described in layer 3 and about 76 mg/m$^2$ of polyacylamide;
9. a layer comprising about 100 mg/m$^2$ of a scavenger, 1-octadecyl-4,4-dimethyl-2-[2-hydroxy-5-N-(7-caprolactamido)sulfonamido-phenyl]thiazolidine, about 20 mg/m$^2$ of a magenta filter dye and about 440 mg/m$^2$ of gelatin;

10. a yellow filter layer comprising about 280 mg/m$^2$ of a benzidine yellow dye and about 105 mg/m$^2$ of gelatin;

11. a yellow image dye-providing layer comprising about 910 mg/m$^2$ of a yellow image dye-providing material represented by the formula

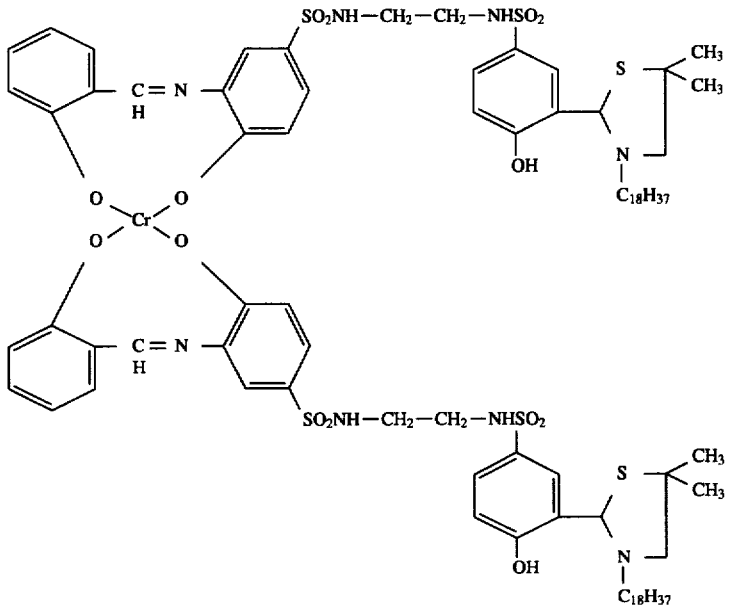

and about 364 mg/m$^2$ of gelatin;

12. a layer coated at a coverage of about 850 mg/m$^2$ of a hydrogen-bonded complex of norbornyltertiarybutyl hydroquinone (NTBHQ) and dimethylterephthalamide (DMPTA) and about 350 mg/m$^2$ of gelatin;

13. a blue-sensitive silver iodobromide layer comprising about 81 mg/m$^2$ of silver iodobromide (1.2 μm), about 189 mg/m$^2$ of silver iodobromide (2.0 μm) and about 135 mg/m$^2$ of gelatin; and 14. a layer comprising about 400 mg/m$^2$ of an ultraviolet filter material, Tinuvin (Ciba-Geigy), about 200 mg/m$^2$ ditertiarybutyl hydroquinone (DTBHQ), about 50 mg/m$^2$ of a releasable antifoggant

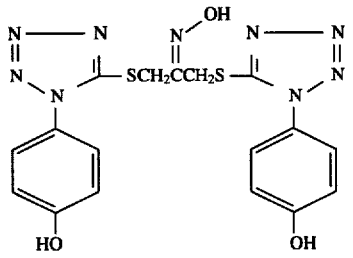

about 80 mg/m$^2$ of a benzidine yellow filter dye and about 73 mg/m$^2$ of gelatin.

The photosensitive element utilized in the "test" diffusion transfer photographic film unit was the same as described above except that layer 4 included about 75 mg/m$^2$ of 3-acetylpyridine-N-oxide.

The example film units were prepared utilizing the image-receiving elements and photosensitive elements as described above. In each case, after photoexposure of the photosensitive element, the image-receiving element and the photosensitive element were arranged in face-to-face relationship, i.e. (with their respective supports outermost) and a rupturable container containing an aqueous alkaline processing composition was affixed between the image-receiving and photosensitive elements at the leading edge of each film unit such that the application of compressive pressure to the container would rupture the seal of the container along its marginal edge and distribute the contents uniformly between the respective elements. The chemical composition of the aqueous alkaline processing composition utilized for the processing of the film units is set forth in Table III.

TABLE III

| COMPONENT | PARTS BY WEIGHT |
|---|---|
| hypoxanthine | 9.98 |
| 1-methylimidazole | 0.29 |
| guanine | 0.15 |
| potassium hydroxide | 8.55 |
| p-hydroxyphenylmercaptotetrazole | 0.005 |
| bis-6-methylaminopurine | 0.03 |
| titanium dioxide | 0.20 |
| 6-methyluracil | 0.54 |
| pentanolamine | 1.96 |
| hydrophobically modified HEC | 3.36 |
| 1,2,4-triazole | 0.35 |
| phenylmercaptotetrazole | 0.004 |
| 2,3-cyclohexeno-1-ethylpyridinium tosylate | 2.40 |
| water | Balance to 100 |

Each film unit, after exposure to a sensitometric target, was passed through a pair of rollers set at a gap spacing of about 0.0034 inch (0.0864 mm) and after an imbibition period of 90 seconds the photosensitive and image-receiving elements were separated from each other.

The red, green and blue maximum ($D_{max}$) and minimum ($D_{min}$) reflection densities which were read on a MacBeth Densitometer are shown in Table IV below.

TABLE IV

| FILM UNIT | RED | | GREEN | | BLUE | |
|---|---|---|---|---|---|---|
| | $D_{max}$ | $D_{min}$ | $D_{max}$ | $D_{min}$ | $D_{max}$ | $D_{min}$ |
| Control | 1.59 | 0.12 | 1.73 | 0.12 | 1.44 | 0.07 |
| Test | 1.54 | 0.13 | 2.01 | 0.13 | 1.53 | 0.06 |

In addition, the saturation and upper cut values for the cyan, magenta and yellow columns of the image are shown in Table V.

TABLE V

| FILM UNIT | SATURATION | | | UPPERCUT | | |
|---|---|---|---|---|---|---|
| | C | M | Y | C | M | Y |
| Control | 0.83 | 1.68 | 1.06 | 989 | −102 | 93 |
| Test | 0.93 | 1.87 | 1.09 | 374 | −192 | 2 |

Uppercut is defined as the difference in dye density between the neutral column and the color column integrated between the white point and the speed point divided by the dye range. The speed point is the log of the exposure corresponding to 0.75 density and the white point is two stops slower than the speed point. A decrease in the uppercut value such as shown in Table V for the cyan dye, i.e., 989 to 374, indicates decreased dye control in the toe region of the neutral column due to exposure of other emulsions, i.e., decreased undesirable interimage effects, e.g., by the green and blue sandwiches in the case of the cyan dye.

These data illustrate the improvements exhibited by the film unit of the invention. The film unit of the invention exhibited decreased interimage effects between the red and green color components (decreased control of diffusible cyan dye developer by green-sensitive silver halide) as evidenced by the increased cyan saturation and the lower cyan uppercut. In addition, the film unit of the invention exhibited decreased interimage effects between the green and blue color components (decreased control of diffusible magenta dye developer by the blue-sensitive silver halide) as evidenced by significantly increased magenta saturation and significantly lower magenta uppercut. Further, the image provided by the film unit of the invention exhibited less visual sensation of nonuniformity, i.e., it had reduced graininess.

Although the invention has been described in detail with respect to various preferred embodiments thereof, those skilled in the art will recognize that the invention is not limited thereto but rather that variations and modifications can be made which are within the spirit of the invention and the scope of the appended claims.

What is claimed is:

1. A diffusion transfer photographic film unit comprising:

a photosensitive element comprising a support carrying at least one silver halide emulsion layer;

a second sheet-like element which is superposed or superposable on said photosensitive element;

an image-receiving layer positioned in one of said photosensitive or second sheet-like elements;

means providing an aqueous alkaline processing composition for initiating development of said silver halide emulsion after photoexposure to form an image on said image-receiving layer; and an acylpyridine-N-oxide compound represented by the formula

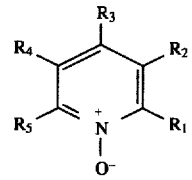

(I)

wherein:

$R_1$, $R_2$, $R_3$, $R_4$ and $R_5$ are each independently:

(a) hydrogen;

(b) linear or branched alkyl ($C_nH_{2n+1}$) wherein: n is an integer from 1 to 22;

(c) alkyl substituted with a photographically-acceptable substituent;

(d) aryl;

(e) aryl substituted with a photographically-acceptable substituent;

(f) $R_1$ and $R_2$, $R_2$ and $R_3$, $R_3$ and $R_4$ or $R_4$ and $R_5$, taken together, can represent a saturated or an unsaturated, 5- or 6-member carbocyclic or heterocyclic ring wherein the heteroatom is nitrogen, sulfur, or oxygen; or (g) halogen;

provided that at least one of $R_1$, $R_2$, $R_3$, $R_4$ and $R_5$ is an acyl group, represented by the formula below

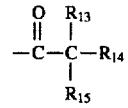

wherein:

$R_{13}$, $R_{14}$ and $R_{15}$ are each independently:

hydrogen;

linear or branched alkyl ($C_nH_{2n+1}$);

alkyl substituted with a photographically-acceptable substituent;

alkoxy having from 1 to 22 carbon atoms; or halogen;

provided that at least one of $R_{13}$, $R_{14}$ or $R_{15}$ is hydrogen.

2. A diffusion transfer photographic film unit according to claim 1 wherein said photographically-acceptable substituent is selected from the group consisting of:

(a) aryl;

(b) alkoxy having from 1 to 22 carbon atoms;

(c) halogen;

(d) a group represented by

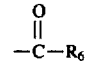

wherein:

$R_6$ is hydrogen, linear or branched alkyl ($C_nH_{2n+1}$), alkoxy having from 1 to 22 carbon atoms, or $N(R_7)_2$ wherein $R_7$ is linear or branched alkyl ($C_nH_{2n+1}$);

(e) a group represented by

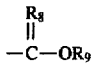

wherein:

$R_8$ is oxygen or sulfur, $R_9$ is hydrogen or a linear or branched alkyl ($C_nH_{2n+1}$); and (f) a group represented by

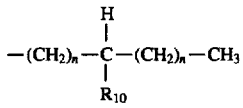

wherein:

$R_{10}$ is halogen, linear or branched alkyl ($C_nH_{2n+1}$),

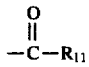

wherein:

$R_{11}$ is hydrogen, aryl, linear or branched alkyl ($C_nH_{2n+1}$), or

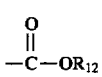

wherein:

$R_{12}$ is linear or branched alkyl ($C_nH_{2n+1}$).

3. A diffusion transfer photographic film unit according to claim 1 wherein said means providing an aqueous alkaline processing composition is a rupturable container releasably holding said processing composition and so positioned as to be adapted to distribute said processing composition between predetermined layers of said elements.

4. A diffusion transfer photographic film unit according to claim 1 wherein said image-receiving layer is located in said second sheet-like element and further including a strip-coat layer overlying said image-receiving layer.

5. A diffusion transfer photographic film unit according to claim 1 wherein said image-receiving layer is located in said second sheet-like element and further including an overcoat layer residing on said image-receiving layer.

6. A diffusion transfer photographic film unit according to claim 1 wherein said image-receiving layer is located in said second sheet-like element, and said second sheet-like element carries a timing layer and a polymeric acid-reacting layer between said second sheet-like support and said image-receiving layer.

7. A diffusion transfer photographic film unit according to claim 5 further including a strip-coat residing on said overcoat layer.

8. A diffusion transfer photographic film unit according to claim 1 wherein said photosensitive element includes an image dye-providing material in association with said silver halide emulsion layer.

9. A diffusion transfer photographic film unit according to claim 8 wherein said photosensitive element comprises a support carrying a red-sensitive silver halide emulsion having a cyan image dye-providing material associated therewith, a green-sensitive silver halide emulsion layer having a magenta image dye-providing material associated therewith and a blue-sensitive silver halide emulsion layer having a yellow image dye-providing material associated therewith.

10. A diffusion transfer photographic film unit according to claim 9 wherein said yellow image dye-providing material is an image dye-releasing thiazolidine and each of said cyan and magenta image dye-providing materials is a dye developer.

11. A diffusion transfer photographic film unit according to claim 1 wherein said acylpyridine-N-oxide compound is present in said processing composition.

12. A diffusion transfer photographic film unit according to claim 1 wherein said acylpyridine-N-oxide compound is present in said photosensitive element.

13. A diffusion transfer photographic film unit according to claim 1 wherein said acylpyridine-N-oxide compound is selected from the group consisting of 2-acetylpyridine-N-oxide, 3-acetylpyridine-N-oxide and 4-acetylpyridine-N-oxide.

14. A diffusion transfer photographic film unit according to claim 4 wherein said strip-coat comprises a terpolymer of acrylic acid, hydroxypropyl methacrylate and 4-vinylpyrrolidone and carboxymethyl guar.

15. A photographic method comprising the steps of exposing a photosensitive element which contains at least one silver halide emulsion layer and developing said exposed photosensitive element with an aqueous alkaline processing composition in the presence of an acylpyridine-N-oxide compound as defined in claim 1, whereby an image is formed.

16. A photographic method according to claim 15 wherein said acylpyridine-N-oxide compound is selected from the group consisting of 2-acetylpyridine-N-oxide, 3-acetylpyridine-N-oxide and 4-acetylpyridine-N-oxide.

17. A photographic method according to claim 15 wherein said acylpyridine-N-oxide compound is initially present in said aqueous alkaline processing composition.

18. A photographic method according to claim 15 wherein said acylpyridine-N-oxide compound is present in said photosensitive element.

19. A photographic method according to claim 15 wherein said photosensitive element includes an image dye-providing material in association with said silver halide emulsion layer.

20. A photographic method according to claim 19 wherein said photosensitive element comprises a support carrying a red-sensitive silver halide emulsion having a cyan image dye-providing material associated therewith, a green-sensitive silver halide emulsion layer having a magenta image dye-providing material associated therewith and a blue-sensitive silver halide emulsion layer having a yellow image dye-providing material associated therewith.

21. A photographic method according to claim 20 wherein said yellow image dye-providing material is an image dye-releasing thiazolidine and each of said cyan and magenta image dye-providing materials is a dye developer.

* * * * *